US010047660B2

(12) United States Patent
Petutschnig et al.

(10) Patent No.: US 10,047,660 B2
(45) Date of Patent: Aug. 14, 2018

(54) LIQUID-COOLED INTERNAL COMBUSTION ENGINE

(71) Applicant: AVL LIST GMBH, Graz (AT)

(72) Inventors: Heinz Petutschnig, Judendorf-Strassengel (AT); Manfred Breitenberger, Graz (AT); Robert Poeschl, Judendorf-Strassengel (AT)

(73) Assignee: AVL List GmbH, Graz (AT)

( * ) Notice: Subject to any disclaimer, the term of this patent is extended or adjusted under 35 U.S.C. 154(b) by 159 days.

(21) Appl. No.: 15/103,630

(22) PCT Filed: Dec. 12, 2014

(86) PCT No.: PCT/EP2014/077489

§ 371 (c)(1),
(2) Date: Jun. 10, 2016

(87) PCT Pub. No.: WO2015/086791

PCT Pub. Date: Jun. 18, 2015

(65) Prior Publication Data

US 2016/0356201 A1 Dec. 8, 2016

(30) Foreign Application Priority Data

Dec. 12, 2013 (AT) ..... A 50819/2013

(51) Int. Cl.
*F01P 3/02* (2006.01)
*F02F 1/40* (2006.01)
(Continued)

(52) U.S. Cl.
CPC ..... *F01P 3/02* (2013.01); *F02F 1/242* (2013.01); *F02F 1/40* (2013.01); *F01P 2003/028* (2013.01); *F01P 2007/146* (2013.01)

(58) Field of Classification Search
CPC .. F01P 3/02; F01P 2003/021; F01P 2003/024; F02F 1/40
See application file for complete search history.

(56) References Cited

U.S. PATENT DOCUMENTS 5,121,714 A 6/1992 Susa et al.
7,318,395 B2 1/2008 Huter et al.
(Continued)

FOREIGN PATENT DOCUMENTS

DE 3317454 11/1984
DE 19803885 8/1999
WO 2012004340 1/2012

OTHER PUBLICATIONS

English Abstract of DE19803885.
English Abstract of DE 3317454.

*Primary Examiner* — Jacob Amick
(74) *Attorney, Agent, or Firm* — Dykema Gossett PLLC

(57) ABSTRACT

The invention relates to a liquid-cooled internal combustion engine (1), comprising: at least one cylinder block (2), which is connected to at least one cylinder head (3); at least one first cooling jacket (4) in the cylinder block (2) and at least one second cooling jacket (5) in the cylinder head (3), wherein the first and the second cooling jackets (4, 5) are arranged in a coolant circuit and are connected to each other with regard to flow; and at least one control element arranged in the coolant circuit. In order to achieve the same flow conditions in the cylinder head in every operating range of the internal combustion engine, the control element according to the invention is formed by a switching device (8), which blocks a bypass flow path (12) far the first cooling jacket (4) and opens a coolant inlet (11) of the first cooling jacket (4) in a first switching position (A) such that in the first switching position (A) the entire coolant is conducted through both cooling jackets (4, 5) in series, and which
(Continued)

blocks the coolant inlet (11) of the first cooling jacket (4) and opens the bypass flow path (12) for the first cooling jacket (4) in a second switching position (B) such that in the second switching position (B) the entire coolant is conducted only through the second cooling jacket (5) while the first cooling jacket (4) is bypassed.

18 Claims, 4 Drawing Sheets

(51) Int. Cl.
*F02F 1/24* (2006.01)
*F01P 7/14* (2006.01)

(56) References Cited

U.S. PATENT DOCUMENTS

| | | | | |
|---|---|---|---|---|
| 8,584,627 | B2 | 11/2013 | Poeschl et al. | |
| 2006/0157002 | A1* | 7/2006 | Pfeffinger ..... | F01P 7/162<br>123/41.29 |
| 2014/0245993 | A1 | 9/2014 | Weber et al. | |

* cited by examiner

LIQUID-COOLED INTERNAL COMBUSTION ENGINE

BACKGROUND OF THE INVENTION

Field of the Invention

The invention relates to a liquid-cooled internal combustion engine, comprising at least one cylinder block which is connected to at least one cylinder head, at least one first cooling jacket in the cylinder block and at least one second cooling jacket in the cylinder head, wherein the first and the second cooling jackets are arranged in a cooling circuit and are connected to each other with regard to flow, and comprising at least one control element arranged in the coolant circuit.

DE 103 06 695 A1 discloses an internal combustion engine with a cooling circuit which comprises a first cooling line for a crankcase and a second cooling line for a cylinder head. The coolant circuit comprises a branch line which leads to the first cooling line and in which a shut-off device is arranged. A second branch line of the coolant circuit is arranged parallel to the first branch line and leads to the first cooling line by bypassing the shut-off device. No coolant reaches the cooling jacket of the crankcase when the shut-off device is closed. The flow only occurs through the cooling jacket of the cylinder head. When the shut-off device is open on the other hand, a portion of the coolant enters the cooling jacket of the cylinder head and another portion enters the cooling jacket of the cylinder housing, wherein the coolant flows from the cooling jacket of the crankcase via passages provided in the cylinder head gasket between the crankcase and the cylinder head into the cooling jacket of the cylinder head, and wherein the coolant flows are combined in the cylinder head.

It is disadvantageous in the case of DE 103 06 695 A1 that the flow field in the cooling jacket of the cylinder head and thus its cooling conditions, especially in the region of the entire fire deck, changes at different positions of the shut-off device because the inflow conditions, especially the direction of flow and the distribution of the coolant, change relevantly.

SUMMARY OF THE INVENTION

It is the object of the invention to avoid these disadvantages and to achieve identical flow conditions in the cylinder head in any operating range of the internal combustion engine.

This is achieved in accordance with the invention in such a way that the control element is formed by a switching device, which blocks a bypass flow path for the first cooling jacket and opens a coolant inlet of the first cooling jacket in a first switching position, such that in the first switching position the entire coolant is conducted through both cooling jackets in series, and which blocks the coolant inlet of the first cooling jacket and opens the bypass flow path for the first cooling jacket in a second switching position, such that in the second switching position the entire coolant is conducted only through the second cooling jacket while the first cooling jacket is bypassed.

The entire coolant quantity shall be understood in this case as the entire coolant quantity supplied to the cylinder block or removed from the cylinder head, less a coolant quantity escaping via at least one potential degassing opening directly between the first and the second cooling jacket. The coolant quantity flowing off through the degassing opening(s) is at most approximately 5% of the entire coolant quantity supplied to the cylinder block or removed from the cylinder head.

Since the coolant flows in the first switching position successively through the first cooling chamber and the second cooling chamber, the directions of flow are identical in every operating range of the internal combustion engine.

This also applies to intermediate positions of the switching device. In the intermediate positions of the switching device, both the coolant inlet of the first cooling jacket and also the bypass flow path of the first cooling jacket are partly open, so that a portion of the coolant is conducted through the first cooling jacket and another portion of the coolant is conducted through the bypass flow path by bypassing the first cooling jacket. The entire coolant also flows through the second cooling jacket in this case.

In every switching position of the switching device, the entire flow supplied by the main feed can flow through the second cooling jacket. The same flow field forms in the second cooling jacket of the cylinder head in every position of the switching device. The flow into the fire deck thus remains unchanged independently of the position of the switching device. The entire coolant quantity always flows through the same inlets and in the same quantity distribution to the fire deck.

The coolant quantity through the first cooling jacket of the cylinder block is therefore variable dependent on load, wherein in every case the entire or complete coolant quantity—less the coolant escaping through a potential degassing opening between the first and second cooling jacket—is guided past the fire deck or through the portion of the second cooling jacket adjoining the fire deck, and is discharged only after cooling the valve bridges.

In order to achieve a flow field in the second cooling jacket which is independent of the switching position, it is advantageous if the flow connection between the first cooling jacket and the second Cooling jacket is arranged in the region of at least one longitudinal side of the internal combustion engine.

The bypass flow path is arranged between the switching device and the second cooling jacket in the cooling circuit. A valve chamber of the switching device can be connected to a main feed of the cooling circuit.

A first distributor strip is arranged in the cooling circuit between the switching device and the first cooling chamber. Furthermore, a second distributor strip can be arranged between the switching device and the second cooling chamber. A flow field of the coolant in the second cooling chamber which is uniform for all switching positions can be achieved when the first cooling chamber is flow-connected, preferably in an exclusive manner, via the second distributor strip to the second cooling chamber, wherein preferably the first cooling chamber is flow-connected per cylinder via at least one respective flow connection to the second distributor strip.

The first and/or second distributor strip can be integrated in the cylinder block or also be formed externally with respect to said cylinder block. It is especially advantageous however if the second distributor strip is integrated in the cylinder head. This allows a highly compact configuration.

The coolant flow through the first cooling jacket can be activated or deactivated by the distributor strips with one single switching device. The second distributor strip can especially be omitted when one switching device is arranged per cylinder, which switching device can be connected via one respective bypass flow path per cylinder to the second cooling jacket.

It is provided in an especially preferred embodiment that the second cooling jacket of the cylinder head comprises an upper and a bottom partial cooling chamber, wherein the bottom partial cooling chamber is arranged between the upper partial cooling chamber and a fire deck of the cylinder head, and wherein the upper partial cooling chamber is flow-connected via a connecting channel directly to the first cooling jacket of the cylinder block, and wherein preferably the second distributor strip is part of the upper partial cooling jacket. The upper and bottom partial cooling chambers are separated from each other by an intermediate deck. A partial cooling chamber which directly adjoins the fire deck is understood in this case as a bottom partial cooling chamber. The upper partial cooling chamber adjoins the bottom partial cooling chamber in the direction of the cylinder axis, wherein an intermediate deck which is penetrated by the injector channel for the injection device is formed between the partial cooling chambers.

The upper partial cooling chamber of the second cooling jacket can act as the distributor strip/collector for the fire deck. The upper partial cooling chamber is in connection with the bottom partial cooling chamber via at least one flow connection, e.g. in the region of a central injection device. The coolant flows from the first cooling jacket of the cylinder block via the connecting channel formed by a connecting pipe for example in the region of a longitudinal side of the internal combustion engine into the upper partial cooling chamber and continues to flow in the transverse direction in the direction of the central injection device, where it reaches the bottom partial cooling chamber through the passage in the intermediate deck and flows in flow channels arranged transversely to the longitudinal plane of the engine or radially to the cylinder axis, thereby cooling thermally critical regions of the fire deck, to the outside and is conducted to a coolant outlet in the region of a longitudinal side of the cylinder head. The central injection device can also be cooled in the region of the passage, wherein the passage can be formed as a throttle and can be used for optimising the inflow to the fire deck.

BRIEF DESCRPTION OF THE DRAWINGS

The invention will be explained below in greater detail by reference to the schematic drawings, wherein.

DETAILED DESCRIPTION OF THE DEPICTED EMBODIMENTS

Figure 1:
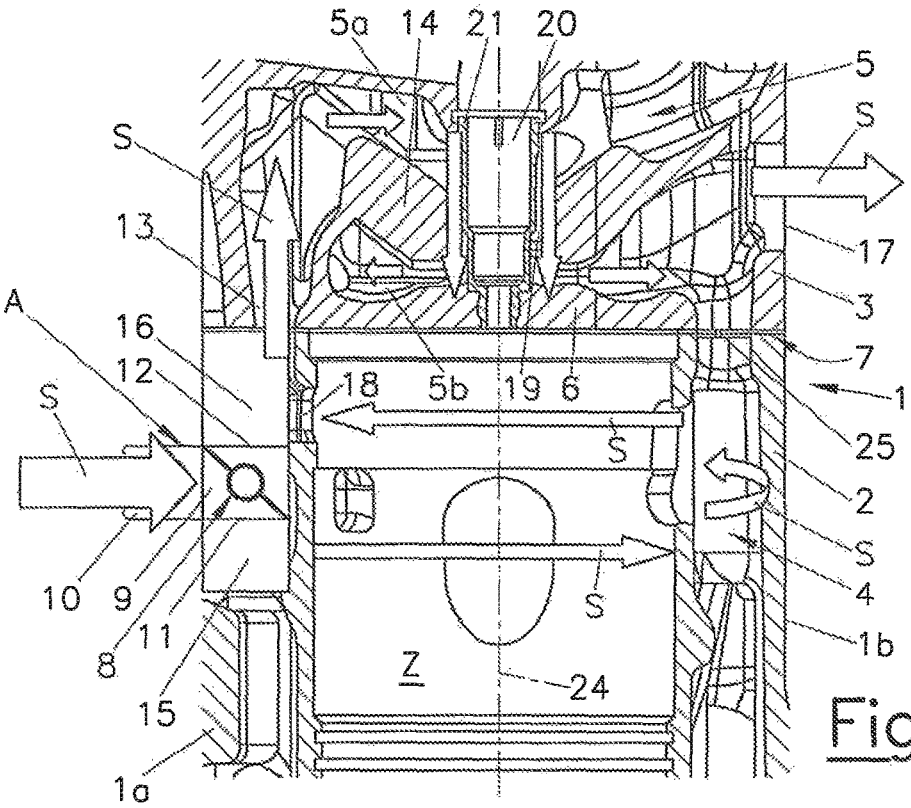
FIG. 1 shows an internal combustion engine in accordance with the invention in a longitudinal sectional view through a cylinder in a transverse plane containing the cylinder axis in a first embodiment in a first switching position of the switching device.

Parts with identical function are designated in the embodiments with the same reference numerals.

FIGS. 1 to 6 each show an internal combustion engine 1 with a cylinder block 2 and a cylinder head 3, wherein a first cooling jacket 4 is arranged in the cylinder block 2 and a second cooling jacket 5 is arranged in the cylinder head 3. The cylinder head 3 is connected to the cylinder block 2 in the region of the fire deck 6, wherein a cylinder head gasket 7 is arranged between the cylinder block 2 and the cylinder head 3. The cylinder axis is designated with reference numeral 24.

The first cooling jacket 4 and the second cooling jacket 5 are part of a cooling circuit, which is not shown in closer detail, for a liquid cooling medium and are flow-connected to each other. In the cooling circuit, a control element formed by a switching device 8 such as a switching flap is arranged, wherein a main feed 10 of the cooling circuit opens into a valve chamber 9. A coolant inlet 11 of the first cooling jacket 4 and a bypass flow path 12 that bypasses the first cooling jacket 4 originate from the valve chamber 9, which bypass flow path leads to the second cooling jacket 5 in the cylinder head 3, e.g. via a transfer channel 13. The flow connection between the main feed 10 and the coolant inlet 11 on the one hand and the bypass flow path 12 on the other hand is controlled by the switching device 8.

The switching device 8 has a first switching position A, a second switching position B and at least one intermediate position C. In the first switching position A, the main feed 10 is only connected to the coolant inlet 11 of the first cooling jacket 4; the flow connection to the bypass flow path 12 is blocked. In the second switching position B, the main feed 10 is only flow-connected to the bypass flow path 12, while the coolant inlet 11 is separated from the main feed 10. In the intermediate position C, the main feed 10 is flow-connected both to the coolant inlet 11 and also to the bypass flow path 12, wherein the distribution of the flows to the coolant inlet 11 and the bypass flow path 12 can be set by the precise position of the switching device 8.

The flow of the coolant is indicated by the bold arrows S. The dashed arrows indicate deactivated flow paths.

In the illustrated embodiments, the second cooling jacket 5 comprises an upper partial cooling chamber 5*a* and a bottom partial cooling chamber 5*b* adjacent to the fire deck 6. An intermediate deck 14 is provided between the upper and the bottom partial cooling chamber 5*a*, 5*b*. A central fuel feed device 20 is provided for each cylinder Z, which feed device is arranged in an injector sleeve 21. In the region of the injector sleeve 21, the intermediate deck 14 comprises passages 19 from the upper partial cooling chamber 5*a* to the bottom partial cooling chamber 5*b*.

Figure 7:
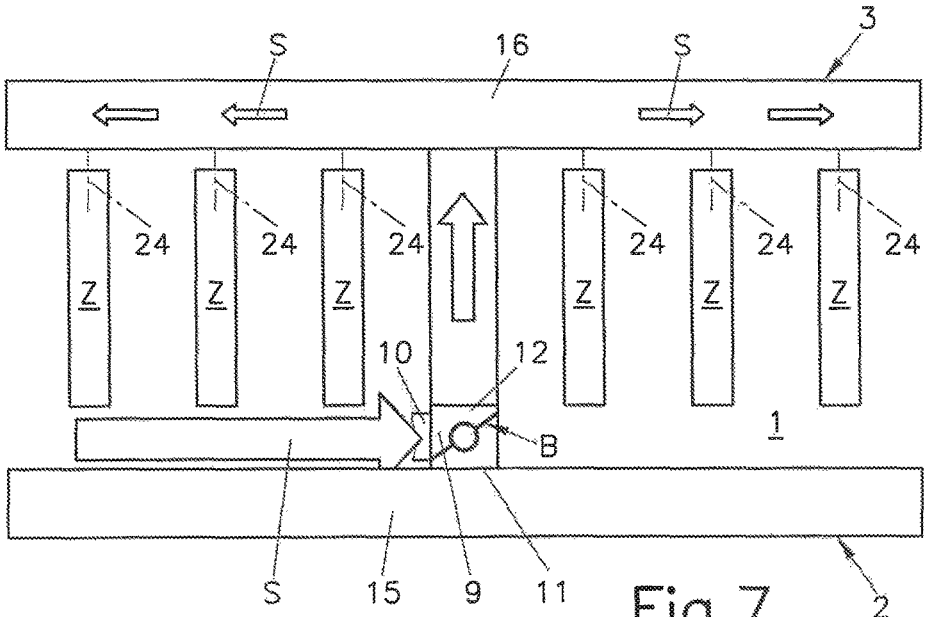
FIG. 7 shows an arrangement of the distributor strips in a side view of this internal combustion engine.

In the embodiments, a first distributor strip 15, which is arranged in the longitudinal direction of the internal combustion engine 1 in the cylinder block 2, adjoins the coolant inlet 11 in the region of a first longitudinal side la of the internal combustion engine 1, which distributor strip evenly distributes the coolant for the first cooling jacket 4 in the longitudinal direction to the individual cylinders Z, as schematically indicated in FIG. 7. The bypass flow path 12 opens into a second distributor strip 16, which can either be arranged in the cylinder block 2 or in the cylinder head 3. It is alternatively also possible to form the distributor strips 15, 16 as separate components connected to the cylinder block 2 or the cylinder head 3. The second distributor strip 16 is used to distribute the coolant in the second cooling jacket 5 in the longitudinal direction in order to achieve even dissipation of heat from thermally critical regions of the cylinder head 3. The second distributor strip 16 can further also assume the function of a collecting strip for coolant flowing for each cylinder Z from the first cooling jacket 4. The second distributor strip 16 can also be part of the upper partial cooling chamber 5*a*.

The coolant is supplied to the upper partial cooling chamber 5*a* in the region of at least one longitudinal side 1*a*, 1*b* of the internal combustion engine 1 and flows according to the arrows S in a radial or transverse manner in the direction of the injector sleeve 21. It reaches the bottom partial cooling chamber 5*b* via the passages 19 and is guided here in the radial or transverse direction over thermally critical regions of the fire deck 6. After flowing through the second cooling jacket 5 substantially in the transverse direction of the internal combustion engine 1, the coolant leaves the cylinder head 3 through a main discharge 17 in the region of a second longitudinal side 1*b* of the internal combustion engine 1 and is optionally recycled via a heat exchanger to a coolant pump (not shown in closer detail).

A degassing opening 25, which is arranged in the cylinder head gasket 7 for example, can be provided between the first cooling jacket 4 and the second cooling jacket 5.

The coolant quantity through the first cooling jacket 4 of the cylinder block 2 can therefore be varied depending on the load, wherein in any case the complete coolant quantity is guided past the fire deck 6 or through the part of the cooling jacket 5 which adjoins the fire deck 6, less the quantity of coolant that escapes via an optional degassing opening 25 (see FIGS. 1 to 3) between the first coolant jacket 4 and the second cooling jacket 5 in the amount of at most 5% of the entire quantity of coolant flowing through the second cooling jacket 2, and is discharged only after cooling the thermally critical regions of the fire deck 6 (e.g. the valve bridges, which are not shown in closer detail).

In each of the embodiments, the main feed 10 and the main discharge 17 are arranged on different longitudinal sides 1*a*, 1*b* of the internal combustion engine 1. It is also possible to position the main feed 10 and the main discharge 17 on the same longitudinal side 1*a*, 1*b*.

Figure 2:
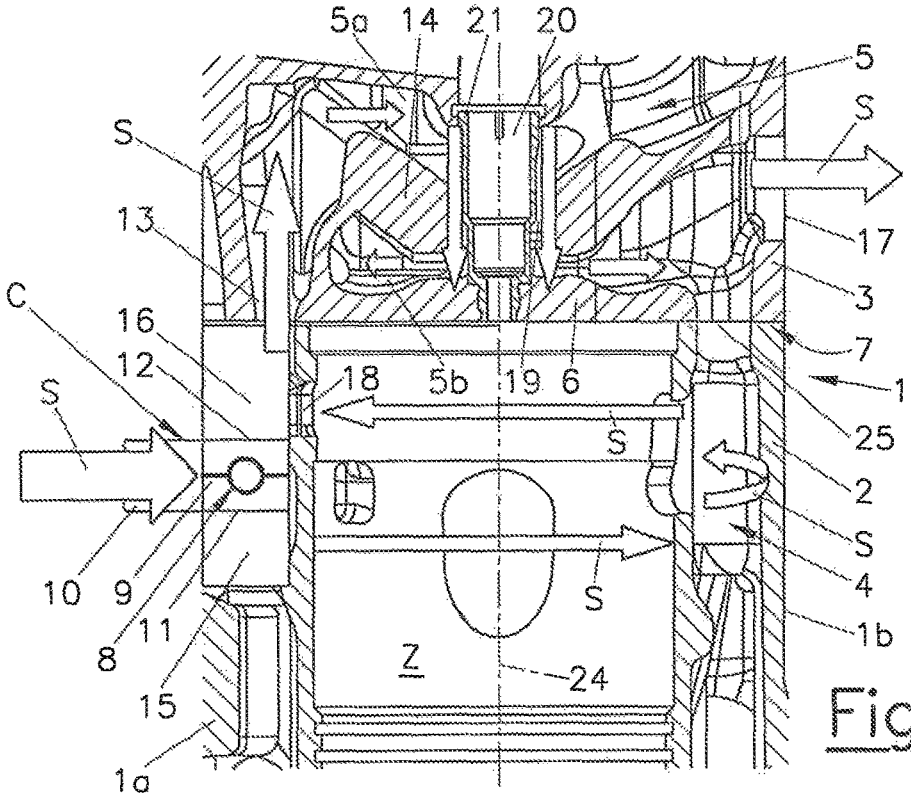
FIG. 2 shows this internal combustion engine in a longitudinal sectional view analogously to FIG. 1 in an intermediate position of the switching device.
Figure 3:
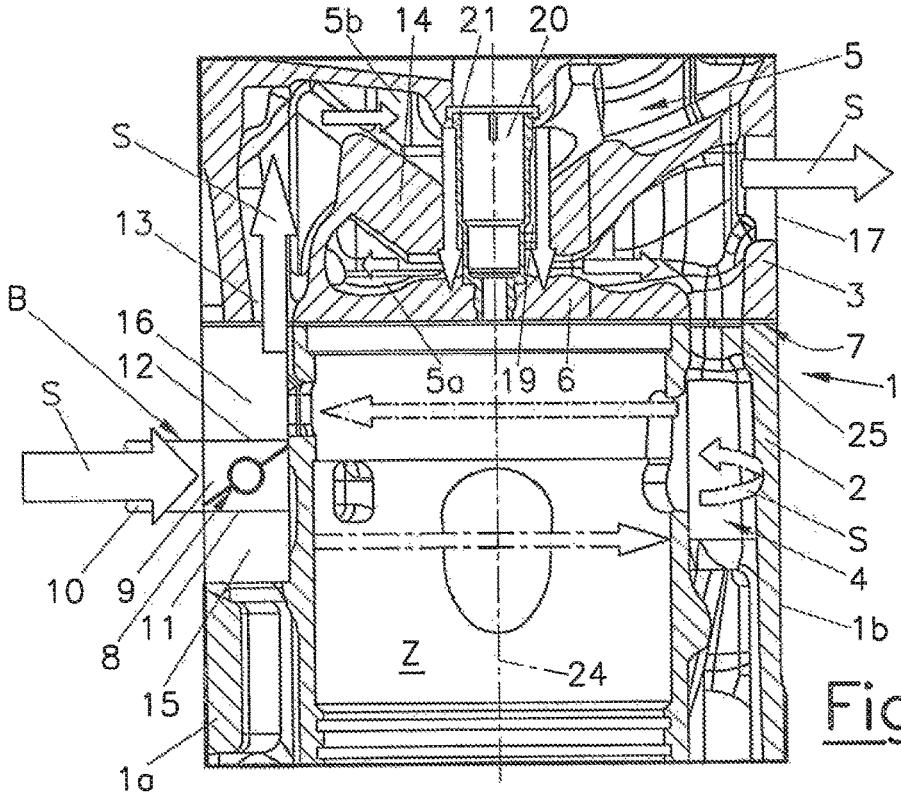
FIG. 3 shows this internal combustion engine in a longitudinal sectional view analogously to FIG. 1 in a second switching position of the switching device.

FIGS. 1 to 3 show a first embodiment, in which both the first and also the second distributor strip 16 are arranged in the cylinder block 2 or in the region of the same first longitudinal side 1*a* of the cylinder block 2.

FIG. 1 shows the switching device 8 in its first switching position A. The coolant flows according to the arrows S from the main feed 10 into the valve chamber 9 of the switching device 8 and is conducted by said device via the coolant inlet 11 to the first distributor strip 15, from which the coolant flows into the first cooling jacket 4 surrounding the cylinder Z. After flowing around the cylinder Z, the coolant reaches the second distributor strip 16 via the connecting channel 18, where the coolant is collected and is supplied via at least one transfer channel 13 to the upper partial cooling chamber 5*a* of the second cooling jacket 5 in the cylinder head 3. The coolant then reaches the bottom partial cooling chamber 5*b* via the passages 19 and leaves the second cooling jacket 5 through the main discharge 17. As is indicated by the arrows S in FIG. 1, the entire coolant supplied through the main feed 10 flows successively through the first and second cooling jacket 4, 5.

FIG. 2 shows the switching device 8 in an intermediate position C, wherein the coolant is divided in the valve chamber 9 of the switching device 8. A first portion of the coolant now flows via the first distributor strip 15, the first cooling jacket 4 and the second distributor strip 16 into the second cooling jacket 5, as in the switching position A shown in FIG. 1. A second portion directly reaches the second distributor strip 16 via the bypass flow path 12, by bypassing the first cooling jacket 4, where it flows together with the first portion of the coolant and is conducted together with said first portion into the second cooling jacket 5. The flow through the upper and bottom partial cooling chambers 5*a*, 5 occurs as in the switching position A.

FIG. 3 shows the switching device 8 in a second switching position B, wherein the coolant inlet 11 or the first distributor strip 15 is separated from the main feed 10, but where the bypass flow path 12 is open. The coolant now flows directly through the bypass flow path 12 into the second distributor strip 16 by bypassing the first cooling jacket 4 and is supplied evenly for all cylinders Z to the upper partial cooling chamber 5*a* of the second cooling jacket 5. The flow through the upper and bottom partial cooling chambers 5*a*, 5*b* occurs as in the switching position A. In order to enable the discharge of the air accumulating in the stagnating coolant flow of the first cooling jacket 4 as a result of incomplete filling of the water system, at least one degassing opening 25 can be provided in the cylinder head gasket 7 for example, via which air can reach the second cooling jacket 5 directly.

Figure 4:
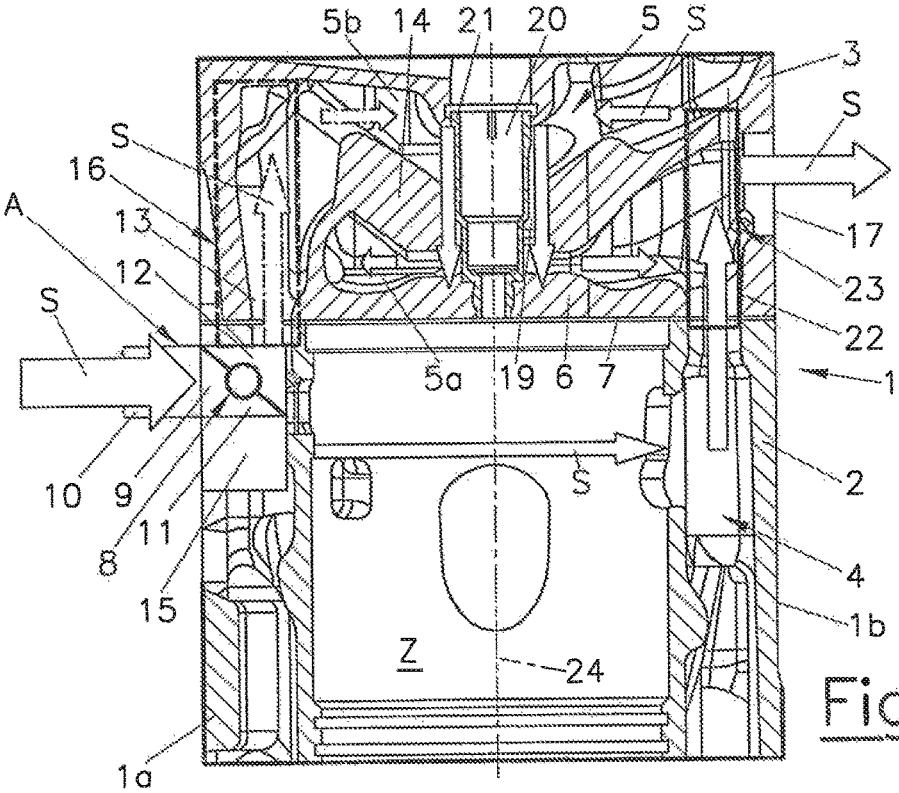
FIG. 4 shows an internal combustion engine in accordance with the invention in a longitudinal sectional view analogously to FIG. 1 in a second embodiment in a first switching position of the switching device.
Figure 5:
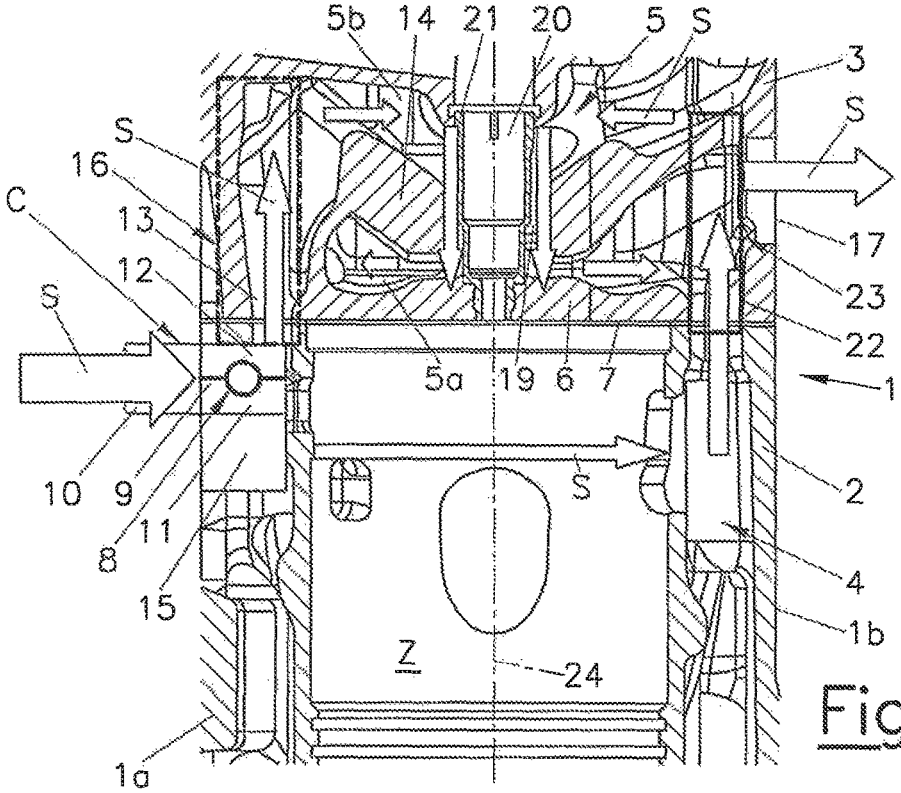
FIG. 5 shows this internal combustion engine in a longitudinal sectional view analogously to FIG. 4 in an intermediate position of the switching device.
Figure 6:
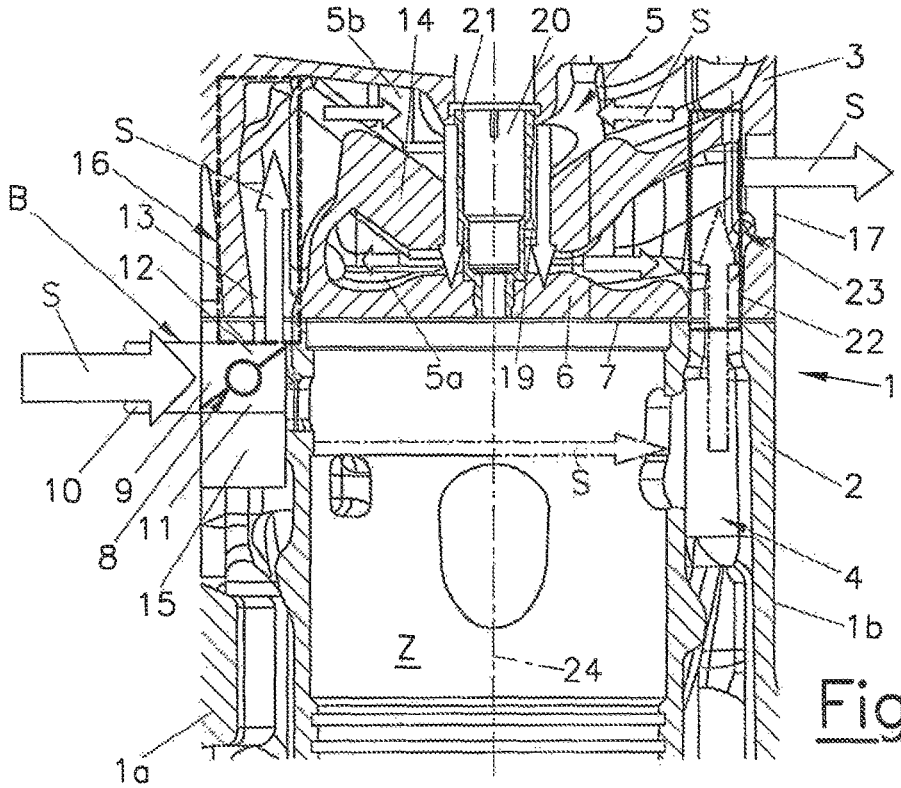
FIG. 6 shows this internal combustion engine in a longitudinal sectional view analogously to FIG. 4 in a second switching position of the switching device.

FIGS. 4 to 6 show a second embodiment in different switching positions of the switching device 8, in which the first distributor strip 15 in the cylinder block 2 is arranged in the region of the longitudinal side la of the cylinder block 2.

FIG. 4 shows the switching device 8 in its first switching position A. The coolant flows according to the arrows S from the main feed 10 into the valve chamber 9 of the switching device 8 and is conducted from said chamber via the coolant inlet 11 to the first distributor strip 15, from which the coolant flows into the first cooling jacket 4 surrounding the cylinders Z. In the region of the second longitudinal side 1*b* of the internal combustion 1 which is arranged opposite the first longitudinal side 1*a*, a connecting channel 23 is arranged, which channel is formed by a connecting pipe 22 and which connects the first cooling jacket 4 to the upper partial cooling chamber 5*a* of the second cooling jacket 5 in the cylinder head 3. The connecting pipe 22 is guided through the bottom partial cooling chamber 5*b*. Since the first cooling jacket 4 is always flow-connected via the connecting channel 23 to the second cooling jacket 5, separate degassing openings can be omitted in this embodiment because any accumulated air in the first cooling jacket 4 as a result of incomplete filling of the water system can be discharged via the connecting channel 23 into the second cooling jacket 5.

After flowing through the first cooling jacket 4 in the transverse direction, the coolant is conducted through the connecting channel 23 into the upper partial cooling chamber 5*a* of the second cooling jacket 5 where the coolant is conducted in the radial direction or in the transverse direction in relation to the central injector sleeve 21. The coolant then reaches the bottom partial cooling chamber 5*b* via the passages 19 and is conducted radially or in the transverse direction to the outside via thermally critical regions of the fire deck 6 and leaves the second cooling jacket 5 through the main discharge 17. As is indicated by the arrows S in FIG. 4, the entire coolant supplied through the main feed 10 also flows successively in this embodiment through the first and the second cooling jacket 4, 5.

FIG. 5 shows the switching device 8 in an intermediate position C, wherein the coolant is divided in the valve chamber 9 of the switching device 8. A first portion of the coolant now flows via the first distributor strip 15, the first cooling jacket 4 and the connecting channel 23 into the upper partial cooling chamber 5*a* of the second cooling jacket 5, as in the switching position A shown in FIG. 4. A second portion directly reaches the second distributor strip 16 arranged in the cylinder head 3 via the bypass flow path 12 by bypassing the first cooling jacket 4, where it flows together with the first portion of the coolant and is conducted together with said first portion through passages 19 into the bottom partial cooling chamber 5*b* of the second cooling jacket 5. The flow through the upper and bottom partial cooling chamber 5*a*, 5*b* occurs as in the switching position A shown in FIG. 4.

FIG. 6 shows the switching device 4 in a second switching position B, wherein the coolant inlet 11 or the first distributor strip 15 is separated from the main feed 10, but the bypass flow path 12 is open. The coolant now flows directly through the bypass flow path 12 into second distributor strip 16 by bypassing the first cooling jacket 4 and is supplied evenly to the upper partial cooling chamber 5*a* of the second cooling jacket 5 for all cylinders Z. The flow through the upper and bottom partial cooling chambers 5*a*, 5*b* occurs as in the switching position A.

The coolant flow to the second distributor strip 16 is shown in FIG. 7 in the second switching position B of the switching device 8 in a schematic side view of the first and second distributor strips 15 and 16, wherein the cylinders Z are symbolised by rectangles. The coolant flow flows from the main feed 10, as indicated by the arrows S, into the valve chamber 9 and is conducted by the switching device 8 to the bypass flow path 12 and further to the second distributor strip 16. The first distributor strip 15 is separated in this switching position B from the main feed 10. The second distributor strip 16 can be formed in the cylinder block 2 or in the cylinder head 3, as a part of the upper partial cooling chamber 5*a*.

The switching device 8 is formed in both embodiments by a switching flap. The switching device 8 can also be realised by two individual shut-off valves with equivalent function, wherein one shut-off valve each can be arranged in the region of the coolant inlet 11 and in the region of the bypass flow path 12. A maximum volume flow through the cylinder head 3 can thus be achieved under all operating conditions and variations of the volume flow of the cylinder block 2 between 0% in the warm-up phase and 100% in the case of full load. This leads to an especially efficient cooling of the cylinder head 3. The cylinder head 3 thus acts as an accumulating element of all partial volume flows.

The combination with the divided second cooling jacket 5 (shown in FIGS. 1 to 6) and the so-called top-down cooling concepts is especially advantageous, in which the coolant flow occurs from the upper partial cooling chamber 5*a* to the bottom partial cooling chamber 5*b*, because different inflow positions at the narrow point in the intermediate deck 14 formed by the passages 19 are compensated in the large upper partial cooling chamber 5*a* and the switching positions of the switching device 8 thus virtually have no influence on the cooling effect of the fire deck 6. The upper partial cooling chamber 5*a* of the second cooling jacket 5 acts as a distributor strip/collector for the fire deck 6. The passages 19, which are formed as a throttle, are used for optimising the inflow to the fire deck 6.

Apart from that, the total volume flow through the main feed 10 can be variable by a controllable water pump or other control elements for example and can be based on the respective cooling needs at thermally critical positions of the cylinder head 3.

The invention claimed is:

1. A liquid-cooled internal combustion engine, comprising a cylinder block which is connected to a cylinder head, a first cooling jacket in the cylinder block and a second cooling jacket in the cylinder head, wherein the first and the second cooling jackets are arranged in a cooling circuit and are connected to each other with regard to flow, and comprising at least one control element arranged in the coolant circuit, wherein the control element is formed by a switching device which blocks a bypass flow path for the first cooling jacket and opens a coolant inlet of the first cooling jacket in a first switching position, such that in the first switching position the entire coolant is conducted through both cooling jackets in series, and which blocks the coolant inlet of the first cooling jacket and opens the bypass flow path for the first cooling jacket in a second switching position, such that in the second switching position the entire coolant is conducted only through the second cooling jacket while the first cooling jacket is bypassed, wherein a first distributor strip is arranged in the cooling circuit between the switching device and the first cooling jacket, and wherein a second distributor strip is arranged in the cooling circuit between the switching device and the second cooling jacket, and wherein the first cooling jacket is flow-connected via the second distributor strip to the second cooling jacket.

2. The internal combustion engine according to claim 1, wherein in an intermediate position of the switching device both the coolant inlet of the first cooling jacket and also the bypass flow path are partly open, so that a portion of the coolant is conducted through the first cooling jacket and another portion of the coolant is conducted through the bypass flow path by bypassing the first cooling jacket, and the entire coolant is conducted through the second cooling jacket.

3. The internal combustion engine according to claim 1, wherein in each switching position of the switching device the entire flow can flow through the second cooling jacket.

4. The internal combustion engine according to claim 1, wherein the flow connection between the first cooling jacket and the second cooling jacket is arranged in the region of at least one longitudinal side of the internal combustion engine.

5. The internal combustion engine according to claim 4, wherein the first cooling jacket and the second cooling jacket are connected to each other only via said flow connection.

6. The internal combustion engine according to claim 1, wherein at least one flow connection is formed between the first and second cooling jacket by the bypass flow path.

7. An internal combustion engine according to claim 1, wherein the bypass flow path is arranged between the switching device and the second cooling jacket in the cooling circuit.

8. The internal combustion engine according to claim 1, wherein a valve chamber of the switching device is connected to a main feed of the cooling circuit.

9. The internal combustion engine according to claim 1, wherein the first distributor strip is integrated in the cylinder block.

10. The internal combustion engine according to claim 1, wherein the first cooling chamber is exclusively flow-connected via the second distributor strip to the second cooling jacket.

11. The internal combustion engine according to claim 1, wherein the first cooling jacket is flow-connected for each cylinder via at least one respective connecting channel to the second distributor strip.

12. The internal combustion engine according to claim 11, wherein the connecting channel between the first cooling jacket an upper partial cooling chamber is arranged on a longitudinal side of the internal combustion engine opposite the coolant inlet of the first cooling jacket.

13. The internal combustion engine according to claim 1, wherein the second distributor strip is integrated in the cylinder block.

14. The internal combustion engine according to claim 1, wherein the second distributor strip is integrated in the cylinder head.

15. The internal combustion engine according to claim 1 wherein the second cooling jacket of the cylinder head comprises an upper partial cooling chamber and a bottom partial cooling jacket, wherein the bottom partial cooling jacket is arranged between the upper partial cooling chamber and a fire deck of the cylinder head, and wherein the upper partial cooling chamber is directly flow-connected via at least one connecting channel to the first cooling jacket of the cylinder block, and wherein the upper and bottom partial cooling chambers are flow-connected to each other via at least one passage.

16. The internal combustion engine according to claim 15, wherein the second distributor strip is part of the upper partial cooling chamber.

17. The internal combustion engine according to claim 15, wherein the connecting channel is formed by a connecting pipe between the first cooling jacket and the upper partial cooling chamber.

18. The internal combustion engine according to claim 1, wherein a switching device is formed for each cylinder, each said switching device being connectable to the second cooling jacket via at least one respective bypass flow path for each cylinder.

* * * * *